US009202366B2

(12) United States Patent
Van Curen et al.

(10) Patent No.: US 9,202,366 B2
(45) Date of Patent: Dec. 1, 2015

(54) WIRELESS COMMUNICATION SYSTEM FOR PAGING, LOCATING AND/OR COMMUNICATING WITH AN OBJECT

(75) Inventors: Greg Van Curen, Fremont, IN (US); Nick Christie, Angola, IN (US)

(73) Assignee: E-Collar Technologies, Garrett, IN (US)

( * ) Notice: Subject to any disclaimer, the term of this patent is extended or adjusted under 35 U.S.C. 154(b) by 661 days.

(21) Appl. No.: 13/291,379

(22) Filed: Nov. 8, 2011

(65) Prior Publication Data

US 2013/0113612 A1 May 9, 2013

(51) Int. Cl.
*G08C 17/02* (2006.01)

(52) U.S. Cl.
CPC ..... *G08C 17/02* (2013.01)

(58) Field of Classification Search
CPC ..... G08C 17/02; G08C 17/00; G07C 2009/00793; G07C 9/00182; A63H 30/04
USPC ..... 340/12.5, 539.15, 573.2, 693.2; 600/549
See application file for complete search history.

(56) References Cited

U.S. PATENT DOCUMENTS

| | | | | |
|---|---|---|---|---|
| 5,936,530 | A * | 8/1999 | Meinhold | 340/573.1 |
| 6,474,269 | B2 * | 11/2002 | So | 119/720 |
| 7,511,627 | B2 * | 3/2009 | Holoyda | 340/573.4 |
| 8,035,756 | B1 * | 10/2011 | Grove et al. | 348/734 |
| 2004/0032333 | A1 * | 2/2004 | Hatt | 340/574 |
| 2004/0032395 | A1 * | 2/2004 | Goldenberg et al. | 345/156 |
| 2008/0312822 | A1 * | 12/2008 | Lucas et al. | 701/204 |

* cited by examiner

*Primary Examiner* — Steven Lim
*Assistant Examiner* — Sisay Yacob
(74) *Attorney, Agent, or Firm* — Taylor IP, P.C.

(57) ABSTRACT

A wireless communication system includes a hand-held transmitter for selectively transmitting at least one wireless signal, and a remote receiver unit including a remote receiver mounted to a strap and receiving the wireless signal. The remote receiver includes a sound generator which is actuated and volume adjusted using the hand-held transmitter, dependent on the wireless signal.

27 Claims, 3 Drawing Sheets

WIRELESS COMMUNICATION SYSTEM FOR PAGING, LOCATING AND/OR COMMUNICATING WITH AN OBJECT

BACKGROUND OF THE INVENTION

1. Field of the Invention

The present invention relates to a communication system for paging, locating and/or communicating with an object, and, more particularly, to such a communication system used with people.

2. Description of the Related Art

Wireless communication systems including a hand-held transmitter and a remote receiver unit are used with animals to train or control the behavior of the animal. For example, a dog training system may include a hand-held transmitter which sends a wireless encoded signal to a remote receiver mounted to a strap which is worn around the neck of the dog. The hand-held transmitter may include multiple buttons, and depending upon which button is depressed by a user, an electrical stimulation with a corresponding amplitude and/or frequency is applied to the skin of the animal.

It is also known to use a tracking system including a hand-held receiver (or transceiver) and a remote unit in the form of a strap mounted transmitter. The remote unit transmits a wireless signal to the hand-held receiver and based on GPS or other known techniques, a location of the remote unit can be established. Tracking systems may also be used for other applications, such as the tracking of Alzheimer's patients, prisoners on minimum detention, etc.

Parents typically desire to know the location of their children at any given time. However, it may also be desirable to provide children with a sense of independence by allowing them to wander away from the direct supervision of the parents. Moreover, it is possible in a crowded environment that a child may simply become separated from the parents. Further, it may be desirable to allow the child to play at a location remote from the parents, while at the same time tracking or communicating with the child.

What is needed in the art is a wireless communication system which allows a child to be tracked, paged or otherwise communicated with, while at the same time having improved security features not allowing the remote receiver unit to be removed or tampered with.

SUMMARY OF THE INVENTION

The present invention provides a wireless communication system including a hand-held transmitter and a remote receiver unit, with the remote receiver unit turned ON/OFF by the hand-held transmitter, and sound(s) generated by the remote receiver unit being actuated and volume adjusted by the hand-held transmitter.

The invention in one form is directed to a wireless communication system including a hand-held transmitter for selectively transmitting at least one wireless signal, and a remote receiver unit including a remote receiver mounted to a strap. The remote receiver receives the wireless signal. The remote receiver includes a siren remotely actuated by the hand-held transmitter. The siren has a volume level which is remotely controlled by the hand-held transmitter.

The invention in another form is directed to a method of wireless communication between a hand-held transmitter and a remote receiver unit. The method includes the steps of: transmitting at least one wireless signal from the hand-held transmitter to the remote receiver unit; actuating a siren on the remote receiver unit, dependent on the wireless signal; and controlling a volume level of the siren, dependent on the wireless signal.

The invention in yet another form is directed to a wireless communication system including a hand-held transmitter for selectively transmitting at least one wireless signal, and a remote receiver unit including a remote receiver mounted to a strap and receiving the wireless signal. The remote receiver includes a sound generator which is actuated and volume adjusted using the hand-held transmitter, dependent on the wireless signal.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DETAILED DESCRIPTION OF THE INVENTION

Figure 1:
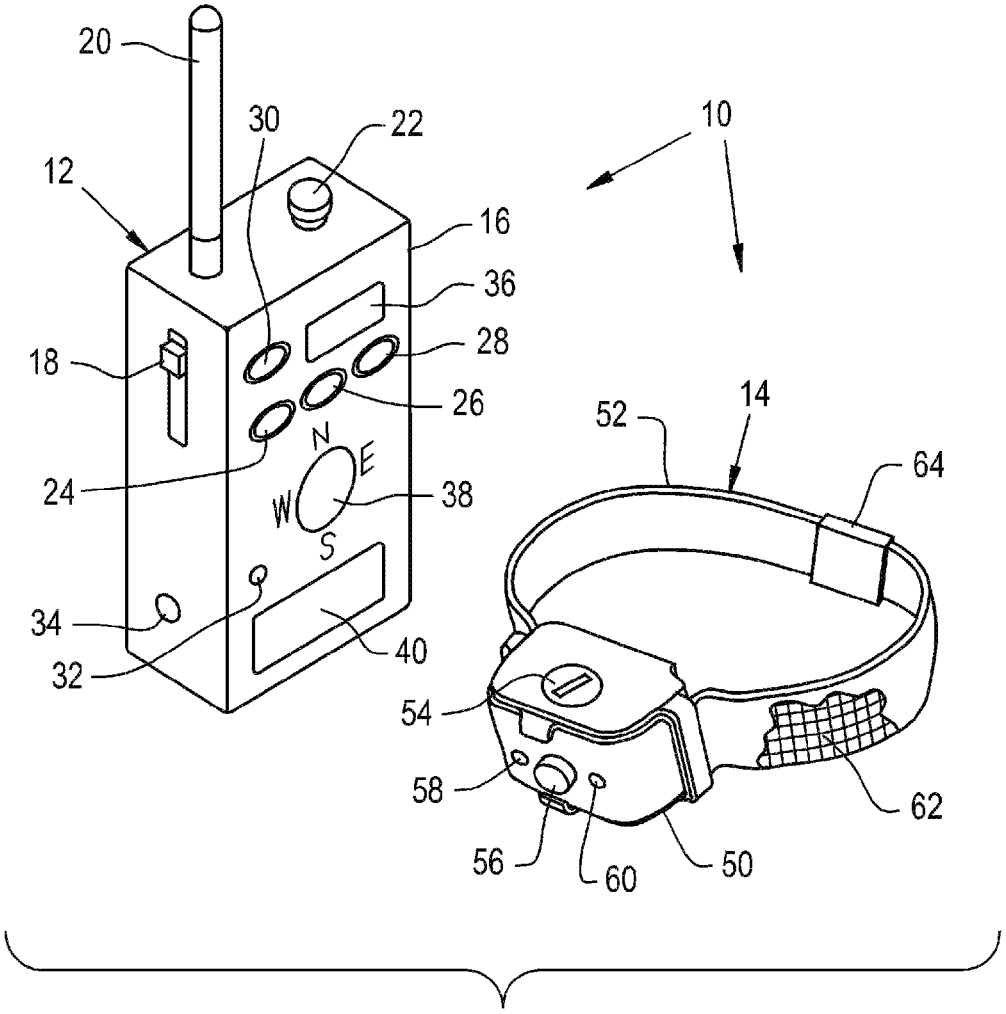
FIG. 1 is a perspective view showing an embodiment of a communication system of the present invention, including a hand-held transmitter and remote receiver unit.

Referring now to the drawings, and more particularly to FIG. 1, there is shown a perspective view of an embodiment of a communication system 10 of the present invention, including a hand-held transmitter 12 and remote receiver unit 14.

Hand-held transmitter 12 generally includes a housing 16 supporting a number of external user interfaces and internal electrical circuitry, each described in more detail below. More particularly, housing 16 carries external user interfaces including an ON/OFF switch 18, antenna 20, remote unit volume control turn dial 22, beep and/or vibrator button 24, siren ON/OFF button 26, light button 28, remote unit ON/OFF button 30, microphone 32, speaker 34 and visual display 36. In the event that hand-held transmitter 12 is equipped with optional global positioning satellite (GPS) circuitry, hand-held transmitter 12 may also include associated visual displays 38 and 40.

Likewise, remote receiver unit 14 includes external features as well as internal electrical circuitry, each described in more detail below. More particularly, housing 50 is mounted to a strap 52. Housing 50 carries an ON/OFF key switch 54, light 56, microphone 58 and speaker 60.

Strap 52 includes a tamper-resistant feature 62 and a lock 64. Lock 64 can be of any suitable configuration and preferably allows strap 52 to be adjustably coupled around the object to be tracked or otherwise communicated with, such as an arm or leg of a child. Lock 62 can be configured, e.g., as a key lock or the like. Tamper-resistant feature 62 inhibits strap 52 from being cut or otherwise removed from the object to be tracked or otherwise communicated with. In the illustrated embodiment, tamper-resistant feature 62 is in the form of a steel mesh which is embedded within strap 52. Tamper-resistant feature 62 could be differently configured, such as a steel wire or cable embedded within or attached to strap 52. Alternatively, tamper-resistant feature 62 could consist of the type of material from which strap 52 is constructed, such as a strap constructed from Kevlar®.

Figure 2:
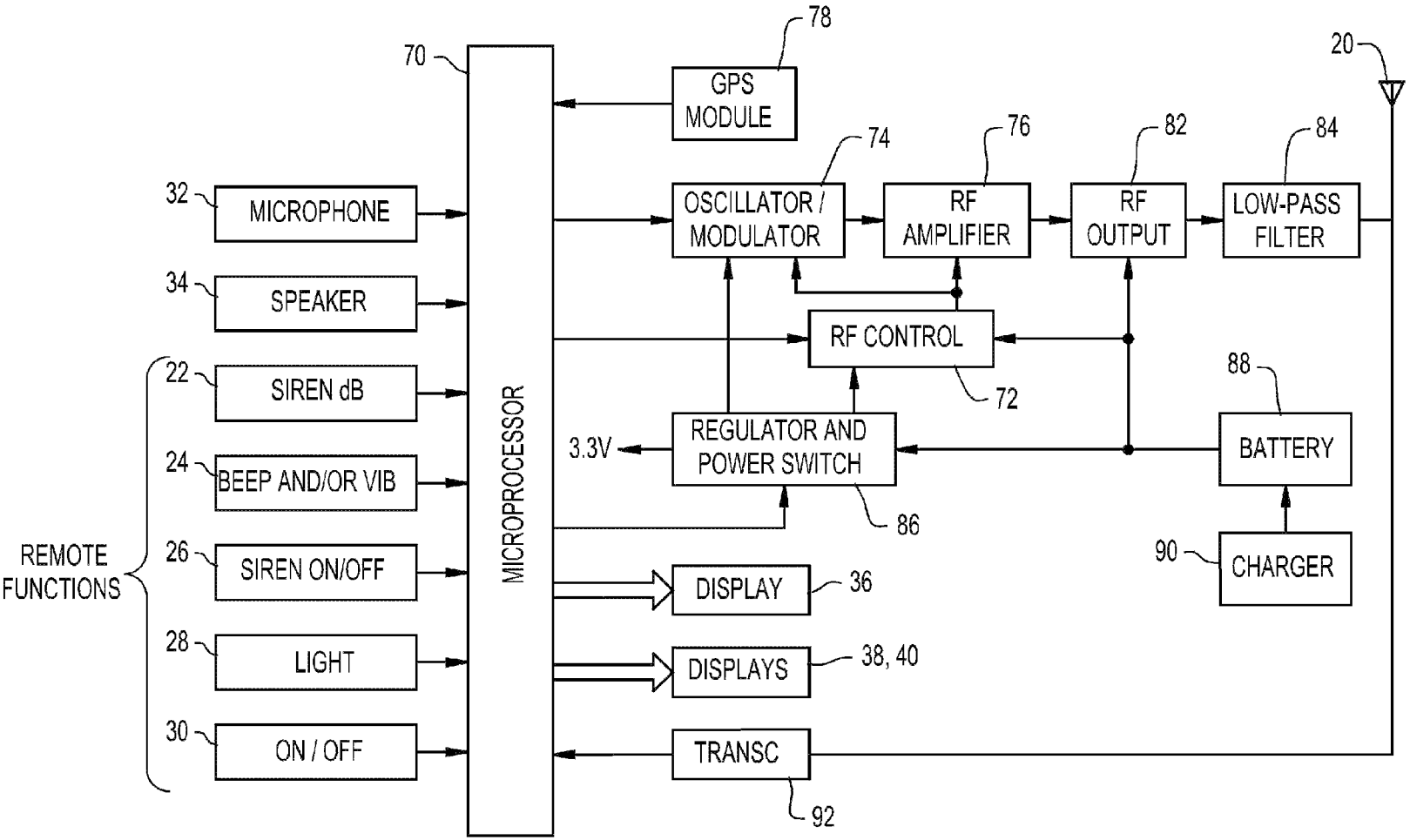
FIG. 2 is a block diagram of an embodiment of the electrical circuitry which may be used with the hand-held transmitter of FIG. 1.

Referring now to FIG. 2, there is shown a block diagram of an embodiment of the electrical circuitry which may be used with hand-held transmitter 12 of FIG. 1. Microprocessor 70 controls all functions which are input from the remote function buttons 22-30 and outputs an ID code signal. Microprocessor 70 also has a power ON/OFF function. Microprocessor 70 recognizes and processes the frequency signal and operates a display 36 and a radio frequency (RF) control 72, which controls an RF oscillator/modulator 74 and an RF amplifier 76 when a button 22-30 is actuated. In an optional 2-way system, microprocessor 70 processes the data received from remote receiver unit 14. For instance, microprocessor 70 can compute a distance between hand-held transmitter 12 and remote receiver unit 14 based on position data from an optional GPS module 78 onboard hand-held transmitter 12 and an optional GPS module 80 (FIG. 3) onboard remote receiver unit 14.

Remote unit volume control turn dial 22 uses a potentiometer as a "volume" (magnitude) control which allows precise control or gradual change of the volume (dB) level of the corresponding siren activated at remote receiver unit 14.

Display 36 can be of any suitable type configuration, such as an LCD display. Display 36 can display, e.g., the level set by the volume control turn dial 22, and a residual battery capacity of hand-held transmitter 12. In an optional two-way system incorporating GPS, optional displays 38 and 40 can display a residual battery capacity of remote receiver unit 14, a direction and distance of remote receiver unit 14 from hand-held transmitter 12, a moving speed of remote receiver unit 14, etc.

RF oscillator/Modulator 74 uses FM (Frequency Modulation), and a modulation-allowable VCXO is applied to give RF oscillation and modulation at the same time. The RF output from the oscillator/modulator 74 is low, so RF amplifier 76 amplifies the output RF such that a following RF output 82 can be operated. RF output 82 amplifies the RF such that the hand-held transmitter 12 and remote receiver unit 14 are within a reachable distance. Low-pass filter 84 blocks high frequencies in the RF signal other than fundamental waves. Antenna 20 transmits RF composed of fundamental waves, which has passed through low-pass filter 84. In the optional two-way system, antenna 20 receives RF signals transmitted from remote receiver unit 14.

Regulator and power switch 86 has a constant-voltage IC function that is operated in association with microprocessor 70. If the ON/OFF switch of hand-held transmitter 12 is moved to the ON position, the power is turned ON. Conversely, if the ON/OFF switch of hand-held transmitter is moved to the OFF position, the power is turned OFF. Battery 88 may be of any suitable type, and preferably is a rechargeable battery. When configured as a rechargeable battery, a charger 90 may be used to keep battery 88 in a charged state. A two-way receiver (transceiver) 92 receives information from remote receiver unit 14, and provides corresponding data to microprocessor 70.

If any one of turn dial 22 or buttons 24-30 are depressed, corresponding data and ID codes set by an ID code setting device are provided to RF oscillator/modulator 74. RF oscillator/modulator 74 generates RF signals that are amplified at RF amplifier 76 and RF output terminal 82, filtered at low-pass filter 84 to remove harmonics, and then emitted through antenna 20 as RF waves.

Figure 3:
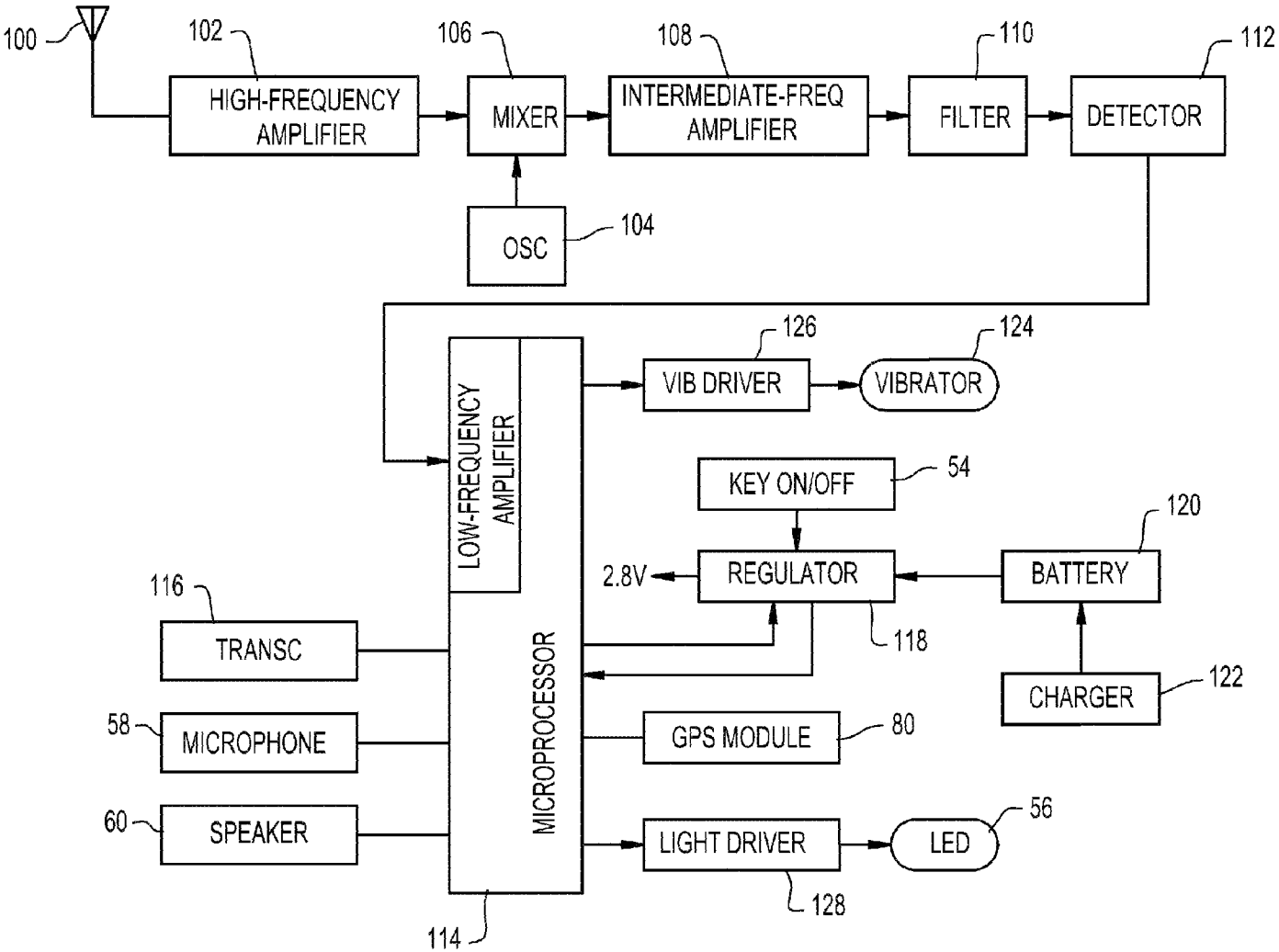
FIG. 3 is a block diagram of an embodiment of the electrical circuitry which may be used with the remote receiver unit of FIG. 1.

Referring now to FIG. 3, there is shown a block diagram of an embodiment of the electrical circuitry which may be used with remote receiver unit 14 of FIG. 1. An antenna 100 receives an RF signal transmitted from hand-held transmitter 12. When configured as a two-way system, antenna 100 transmits an RF signal to hand-held transmitter 12. Antenna 100 is preferably configured as an internal (built-in) antenna, but could also be configured as an external antenna providing an increased operating range.

High-frequency Amplifier 102 amplifies weak RF signals received at antenna 100. An oscillator (OSC, 104) oscillates in itself to give a secondary intermediate frequency. Mixer 106 mixes the RF signal supplied from high-frequency amplifier 102 with the signal supplied from OSC 104 to make an intermediate frequency that is a secondary frequency. An intermediate-frequency amplifier 108 amplifies the intermediate frequencies made at the mixer 106. Filter 110 filters the intermediate frequencies made at the mixer 106 to remove noise. Detector 112 detects function signals and ID signals sent from the hand-held transmitter 12. Microprocessor 114 includes a low-frequency amplifier which amplifies analog signals detected by detector 112. If the received signal is identical to an ID code already stored in memory, a signal from any one of the user inputs selected from turn dial 22 and buttons 24-30 of hand-held transmitter 12 is output. In an optional two-way system, microprocessor 114 processes information associated with remote receiver unit 14 and provides the information to a two-way receiver (transceiver) 116, which in turn transmits the information to hand-held transmitter 12.

Regulator 118 has a constant-voltage IC function that is operated in association with the microprocessor 114. Regulator 118 receives an input signal from keyed ON/OFF switch 54 corresponding to an ON or OFF state of remote receiver unit 14. If the keyed ON/OFF switch 54 is moved to the ON position, the power is turned ON. Conversely, if the keyed ON/OFF switch 54 is moved to the OFF position, the power is turned OFF. Battery 120 may be of any suitable type, and preferably is a rechargeable battery. When configured as a rechargeable battery, a charger 122 may be used to keep battery 120 in a charged state.

An optional GPS module 80 obtains reference signals from at least three satellites to provide microprocessor 114 with position data of remote receiver unit 14.

In the event that remote receiver unit 14 is attached to an animal, such as a human, possible outputs from remote receiver unit 14 which may be perceived at the transmitter and/or receiver unit locations include a vibrator 124 (driven by a vibrator driver 126), a light 56 (such as an LED, driven by a light driver 128), and a speaker 60 (which can be used to produce the sounds of a siren, buzzer, beeper and/or speech).

In the embodiment of remote receiver unit 14 described above, speaker 60 defines a sound generator which can produce any of a number of desired sounds, as described above. However, it is also possible to include a sound generator of a different specific type, such as a buzzer and/or beeper.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wireless communication system, comprising:

a hand-held transmitter for selectively transmitting at least one wireless signal, said hand-held transmitter including a first operator input and a second operator input, said second operator input being a turn dial, said turn dial having a visual indicator, said hand-held transmitter functioning to send data including a magnitude via said at least one wireless signal;

a remote receiver unit including a remote receiver mounted to a strap, said remote receiver receiving said at least one wireless signal, said remote receiver including a siren having a volume level which is remotely activated or deactivated by said first operator input, and is incrementally adjusted in response to said data including said magnitude;

a first microprocessor connected to said first operator input and said second operator input, and to said visual indicator, said first microprocessor being further connected to an oscillator/modulator and an RF control and RF amplifier, said first microprocessor operable to utilize said oscillator/modulator and said RF control and RF amplifier to convert signals from said first operator input and said second operator input into RF output including said at least one wireless signal;

said remote receiver including a high-frequency amplifier, an oscillator/mixer, an intermediate-frequency amplifier, and a filter and detector connected to a second microprocessor, said siren being remotely activated or deactivated by said second microprocessor upon receipt of said at least one wireless signal corresponding to said first operator input and said siren being continuously adjusted by said second microprocessor upon receipt of said at least one wireless signal corresponding to said data including said magnitude proportionate to the position of said turn dial located on said hand-held transmitter independent of said at least one wireless signal corresponding to said first operator input, in real time while said siren is active;

said visual indicator indicating that said wireless signal corresponding to one of said first operator input and said second operator input has been sent by said hand-held transmitter and has been received by said remote receiver unit, and that a corresponding activation or deactivation or continuous adjustment of said siren has been performed.

2. The wireless communication system of claim 1, wherein said hand-held transmitter includes a plurality of operator inputs corresponding to a plurality of remote functions on said remote receiver, said plurality of remote functions including:

a beeper;
a vibrator;
a light;
speech;
and
an ON/OFF state.

3. The wireless communication system of claim 2, wherein said plurality of remote functions are remotely activated or deactivated with said first operator input being in the form of a button on said hand-held transmitter.

4. The wireless communication system of claim 2, wherein said remote receiver includes a speaker, and each of said beeper, said siren and said speech are carried out using said speaker.

5. The wireless communication system of claim 1, wherein said remote receiver further includes a vibrator and a light.

6. The wireless communication system of claim 1, wherein said strap includes a tamper resistant feature and a lock.

7. The wireless communication system of claim 6, wherein said tamper resistant feature includes one of a mesh and a wire embedded within said strap.

8. The wireless communication system of claim 6, wherein said lock includes a key lock.

9. The wireless communication system of claim 1, wherein said visual indicator is a visually perceptible orientation of said dial as it is adjusted.

10. A method of wireless communication between a hand-held transmitter and a remote receiver unit mounted to a strap, said hand-held transmitter including a first operator input and a second operator input, said second operator input being a turn dial, said method of wireless communication comprising the steps of:

transmitting at least one wireless signal from the hand-held transmitter to the remote receiver unit, said at least one wireless signal incorporating data including a magnitude;

activating or deactivating a siren on said remote receiver unit using said first operator input, dependent on said wireless signal;

adjusting a volume level of said siren in response to said at least one wireless signal incorporating data including a magnitude;

a first microprocessor connected to said first operator input and said second operator input, said first microprocessor being further connected to an oscillator/modulator and an RF control and RF amplifier, said first microprocessor operable to utilize said oscillator/modulator and said RF control and RF amplifier to convert signals from said first operator input and said second operator input into RF output including said at least one wireless signal;

said remote receiver unit including a high-frequency amplifier, an oscillator/mixer, an intermediate-frequency amplifier, and a filter and detector connected to a second microprocessor, said siren being remotely activated or deactivated by said second microprocessor upon receipt of said at least one wireless signal corresponding to said first operator input and said siren being continuously adjusted by said second microprocessor upon receipt of said at least one wireless signal corresponding to said data including said magnitude proportionate to the position of said turn dial located on said hand-held transmitter independent of said at least one wireless signal corresponding to said first operator input, in real time while said siren is active.

11. The method of claim 10, wherein said hand-held transmitter includes a plurality of operator inputs corresponding to a plurality of remote functions on said remote receiver, said plurality of remote functions including:

a beeper;
a vibrator;
a light;
speech;
and
an ON/OFF state.

12. The method of claim 11, wherein said plurality of remote functions are remotely activated or deactivated with said first operator input being in the form of a button on said hand-held transmitter, and said volume level is remotely and incrementally adjusted using said turn dial.

13. The method of claim 11, wherein said remote receiver includes a speaker, and each of said beeper, said siren and said speech are carried out using said speaker.

14. The method of claim 10, wherein said remote receiver further includes a vibrator and a light.

15. The method of claim 10, wherein said strap includes a tamper resistant feature and a lock.

16. The method of claim 15, wherein said tamper resistant feature includes one of a mesh and a wire embedded within said strap.

17. The method of claim 15, wherein said lock includes a key lock.

18. A wireless communication system, comprising:

a hand-held transmitter including a first operator input and a second operator input, said second operator input being a dial for selectively transmitting at least one wireless signal, said hand-held transmitter functioning to send data including a magnitude via said at least one wireless signal; and a remote receiver unit including a remote receiver mounted to a strap and receiving said wireless signal, said remote receiver including a sound generator which is activated or deactivated using said first operator input and is adjustable in a volume level in response to said data including said magnitude;

a first microprocessor connected to said first operator input and said second operator input, said first microprocessor being further connected to an oscillator/modulator and an RF control and RF amplifier, said first microprocessor operable to utilize said oscillator/modulator and said RF control and RF amplifier to convert signals from said first operator input and said second operator input into RF output including said at least one wireless signal;

said remote receiver including a high-frequency amplifier, an oscillator/mixer, an intermediate-frequency amplifier, and a filter and detector connected to a second microprocessor, said sound generator being remotely activated or deactivated by said second microprocessor upon receipt of said at least one wireless signal corresponding to said first operator input and said volume of said sound generator being continuously adjusted by said second microprocessor upon receipt of said at least one wireless signal corresponding to said data including said magnitude proportionate to the position of said dial located on said hand-held transmitter independent of said at least one wireless signal corresponding to said first operator input, in real time while said sound generator is active.

19. The wireless communication system of claim 18, wherein said sound generator comprises one of a speaker, a buzzer and a beeper.

20. The wireless communication system of claim 18, wherein said sound generator generates at least one of a siren, a buzz, a beep and speech.

21. The wireless communication system of claim 20, wherein said sound generator is a speaker.

22. The wireless communication system of claim 18, wherein said hand-held transmitter includes a plurality of operator inputs corresponding to a plurality of remote functions on said remote receiver, said plurality of remote functions including:

a beeper;
a vibrator;
a light;
a siren;
speech; and
an ON/OFF state.

23. The wireless communication system of claim 22, wherein said plurality of remote functions are remotely activated or deactivated with said first operator input being in the form of a button on said hand-held transmitter.

24. The wireless communication system of claim 18, wherein said remote receiver further includes a vibrator and a light.

25. The wireless communication system of claim 18, wherein said strap includes a tamper resistant feature and a lock.

26. The wireless communication system of claim 25, wherein said tamper resistant feature includes one of a mesh and a wire embedded within said strap.

27. The wireless communication system of claim 25, wherein said lock includes a key lock.

* * * * *